US012529294B2

(12) United States Patent
Dowsett et al.

(10) Patent No.: US 12,529,294 B2
(45) Date of Patent: Jan. 20, 2026

(54) SELECTIVE EXTRACTION SYSTEM AND METHOD

(71) Applicant: Completion Products Pte Ltd, Singapore (SG)

(72) Inventors: Graeme Dowsett, Singapore (SG); Anush Rajaram, Singapore (SG); Prabhakaran Lakshmanan, Singapore (SG)

(73) Assignee: Completion Products Pte Ltd, Singapore (SG)

( * ) Notice: Subject to any disclaimer, the term of this patent is extended or adjusted under 35 U.S.C. 154(b) by 254 days.

(21) Appl. No.: 17/535,232

(22) Filed: Nov. 24, 2021

(65) Prior Publication Data

US 2023/0133348 A1 May 4, 2023

(30) Foreign Application Priority Data

Nov. 3, 2021 (SG) ..... 10202112248W

(51) Int. Cl.
*E21B 43/12* (2006.01)
*E21B 33/124* (2006.01)
*E21B 43/08* (2006.01)

(52) U.S. Cl.
CPC ..... *E21B 43/12* (2013.01); *E21B 33/124* (2013.01); *E21B 43/08* (2013.01)

(58) Field of Classification Search
CPC ..... E21B 33/124; E21B 43/08; E21B 43/12; E21B 43/14; E21B 47/11
See application file for complete search history.

(56) References Cited

U.S. PATENT DOCUMENTS

| | | | | |
|---|---|---|---|---|
| 6,622,794 | B2 * | 9/2003 | Zisk, Jr. | E21B 34/08 166/205 |
| 6,857,476 | B2 * | 2/2005 | Richards | E21B 43/088 166/227 |
| 6,978,840 | B2 * | 12/2005 | Henderson | E21B 43/12 166/380 |
| 10,215,003 | B2 * | 2/2019 | Devarajan | E21B 47/11 |
| 2006/0113089 | A1 * | 6/2006 | Henriksen | E21B 43/12 166/321 |
| 2007/0246407 | A1 * | 10/2007 | Richards | E21B 43/12 138/40 |

* cited by examiner

*Primary Examiner* — Yong-Suk (Philip) Ro
(74) *Attorney, Agent, or Firm* — JCIP; Joseph G. Chu

(57) ABSTRACT

An extraction system for extracting hydrocarbons from a well is provided. The system comprises an extraction string. The extraction string comprises a plurality of screen assemblies. The screen assemblies comprises screens positioned about a base pipe. The extraction system further comprises a plurality of fluid isolation devices arranged to divide the extraction string into zones. Each zone has at least one sliding sleeve door (SSD). The SSD is arranged to be selectively operable to permit, or prevent, ingress into the base pipe. Each zone is arranged to be individually open to receive an ingress or closed to seal that zone from receiving ingress.

4 Claims, 6 Drawing Sheets

SELECTIVE EXTRACTION SYSTEM AND METHOD

CROSS-REFERENCE TO RELATED APPLICATION

This application claims benefit of priority to Singaporean Patent Application No. 10202112248W, filed Nov. 3, 2021, the entire disclosures of which are incorporated herein by reference.

FILED OF THE INVENTION

The invention relates to the extraction of hydrocarbons (eg Oil and/or Gas) from a well. In particular, the invention relates to the use of downhole equipment for said extraction.

BACKGROUND

Extraction of hydrocarbons from a relatively new reservoir results in high concentrations of the desired asset. At any stage during the life of the reservoir, having to manage entrained material is inevitable but relatively easy to remove in a downstream process once the hydrocarbon has been extracted.

One undesirable by-product is water. As the reservoir is depleted, the water table displaces the hydrocarbon, and enters the extraction system. Water is a less easily removed by-product adding costs to the extraction process. Towards the end of the reservoir's productive life, the cost of excessive entrained water may therefore end the economic life of the reservoir, particularly at a time when global oil prices are depressed.

SUMMARY OF INVENTION

In a first aspect, the invention provides an extraction system for extracting hydrocarbons from a well, the system comprising: an extraction string comprising a plurality of screen assemblies; said screen assemblies comprising screens positioned about a base pipe; a plurality of fluid isolation devices arranged to divide the extraction string into zones; each zone having at least one SSD, said SSD arranged to be selectively operable to permit, or prevent, ingress into the base pipe; wherein each zone is arranged to be individually open to receive an ingress or closed to seal that zone from receiving ingress.

In a second aspect, the invention provides a method for extracting hydrocarbons from a well using an extraction string comprising a plurality of screen assemblies, the method comprising the steps of: dividing the extraction string into fluidly isolated zones; identifying a composition of an ingress from each zone into the screen assemblies; selectively opening or closing SSD's in the zones and, consequently; sealing or unsealing a zone based upon said composition.

It will be appreciated that, as the water table displaces oil, these may not be homogeneous. Different portions of the reservoir may become depleted faster, or the water table may impede further in some areas than others.

Accordingly, the invention provides the ability to selectively block extraction in a zone having excessive concentrations of water, whilst maintaining extraction from other zones within the reservoir. Thus, selecting productive zones within the reservoir becomes possible with the present invention within the same well. This substantially decreases extraction costs as well as capital costs in avoiding having to re-drill a well for more productive extraction.

BRIEF DESCRIPTION OF DRAWINGS

It will be convenient to further describe the present invention with respect to the accompanying drawings that illustrate possible arrangements of the invention. Other arrangements of the invention are possible and consequently, the particularity of the accompanying drawings is not to be understood as superseding the generality of the preceding description of the invention.

DETAILED DESCRIPTION

The invention is directed to an extraction system that divides the well into zones. These zones can then be selectively opened or closed, controlling the selectivity of extraction within the reservoir.

Figure 1:
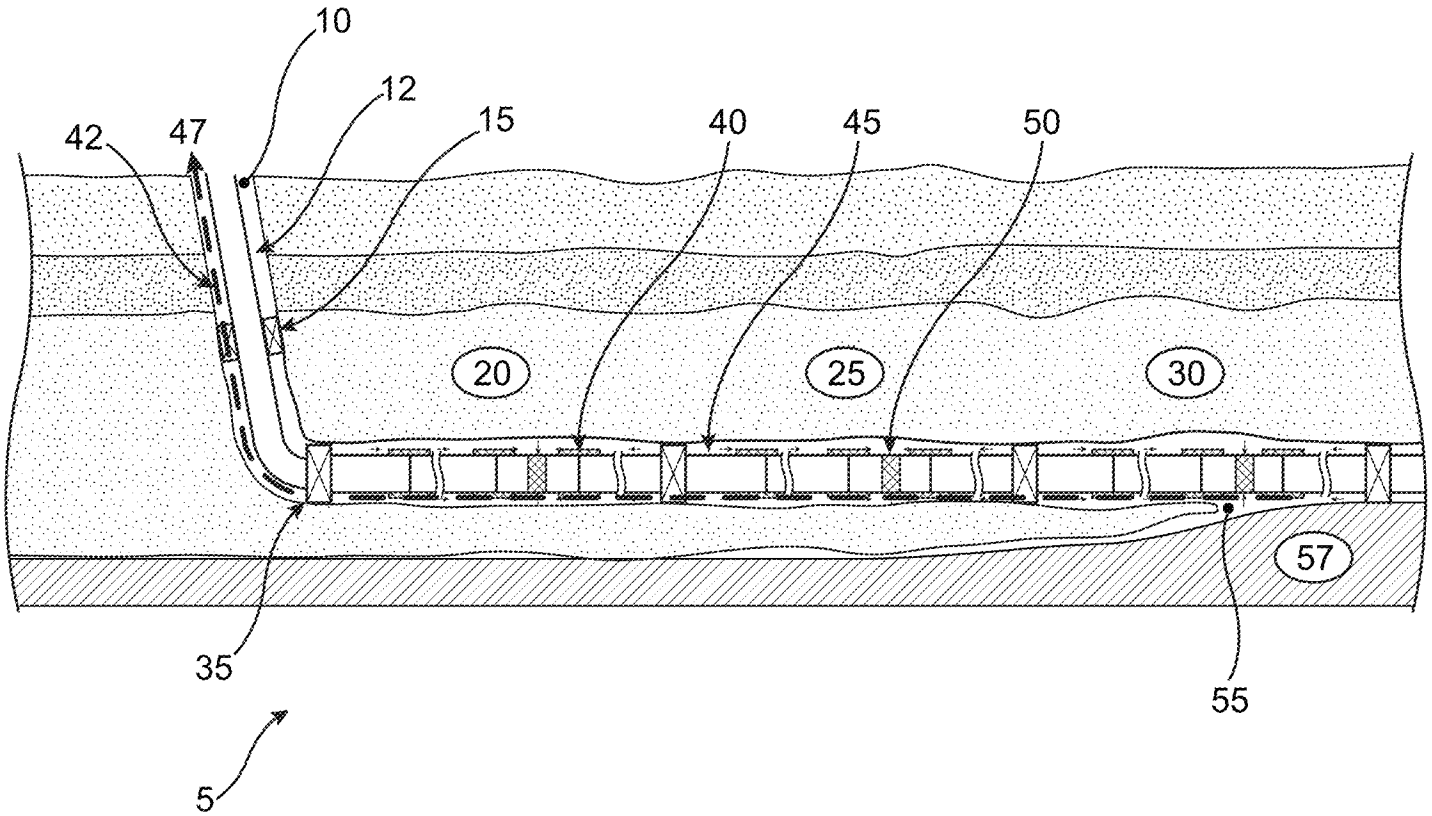
FIG. 1 is a cross sectional view of a well having an extraction system according to one embodiment of the present invention.

FIG. 1 shows one embodiment having an extraction system 5 within a well 10. The extraction system 5 includes a pipe 12, secured by a completion pack 15, and extending from the surface to the desired location within the reservoir. The remainder of the extraction system 5 includes a plurality of screen assemblies to form an extraction string. The extraction string is then divided into zones 20, 25, 30. The zones are sealed so as to be in fluid isolation from each other, using fluid isolation devices, such that the extraction string receives ingress from the reservoir only from the respective zones.

The fluid isolation devices may be swell packs 35, which define the boundaries between each zone, and are located at various intervals of, for instance 10-300 metres. Alternatively, the fluid isolation devices may be injectors to inject a viscous (such as a liquid elastomer) or curable material (such as grout) at the zonal boundary. The actual intervals may be subject to individual installations. The swell packs 35 provide a 4 m independent pup joint which is placed in the string in pre-determined locations to provide annular isolation of production fluids creating independent zones within the wellbore. The swell pack rubber chemistry is designed for the specific well conditions and can be water activated or hydrocarbon activated.

Within each zone is a screen assembly 45 comprising lengths of base pipe connected by flow-through couplings 40 with the ingress fluid entering the screen 45 and flowing towards a sliding sleeve door (SSD) which is selectively closable to prevent the ingress from entering the base pipe 12, or openable to allow the extraction of the hydrocarbon from the respective zones. The selective closure of the SSD may be achieved with an activated with tractor tool or a B Shifting tool.

Tracers 42 may be placed in the extraction string, with a unique signature for each zone. Two types of Tracer may be used. The first is water activated, and thus can be used with the unique signature to identify the water producing zone. The second is an Oil Contact Tracer which is used to quantify the rate of Oil Production.

A sample of production fluids can be sent to a Laboratory for analysis or with equipment at the location itself for analysis. Each zone can be uniquely characterised with quantification of oil produced and also water produced providing critical data for decision making on selective shut-in of zones which are producing unacceptable water. It will be appreciated that the tracer in communicating 47 the data may then trigger an automatic control system that operates the SSDs for a particular zone and thus the use of a tracer may be used to inform an operator to make a decision on the ingress in any particular zone and thus make a decision on whether the SSD is to be closed. That decision, instead, may be made by an automatic control system such that data collected by the tracer 42 is feed back to the system to close the SSD on detecting an unacceptably high concentration of water within the ingress.

It will be further appreciated that, in unusual circumstances, the concentration of water within a particular zone may decrease and thus making the respective zone more productive. In this case, this information can equally be communicated to an operator or a control system to subsequently open the SSD again to continue extraction from that zone.

FIG. 1 further shows where the water table 57 has now infiltrated 55 the zone 30 of the well thus increasing the concentration of water within the ingress. In this circumstance, the SSD may be closed so as to prevent any further ingress from the non-productive zone 30.

Figure 2:
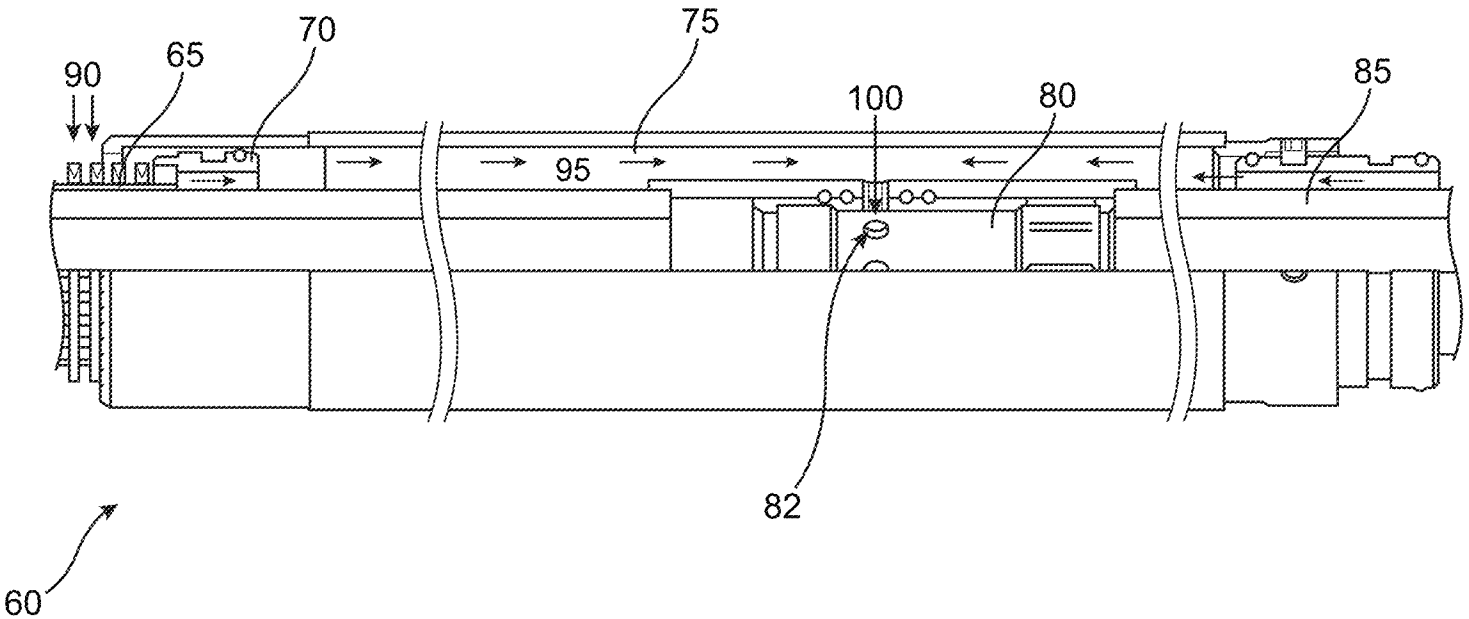
FIG. 2 is a partial cross-sectional view of a screen assembly according to one embodiment of the present invention.

FIG. 2 shows an example of a screen assembly 60 that may be located within a zone. Here a base pipe 85 having a direct wrapped screen 65 and a flow-through shroud 75 receives ingress 90 from the well. The flow-through shroud will be placed on the direct wrap screen 65 during transportation. Upon connecting the screens (coupling on pin end of the other screen), a flow-through coupling will be pulled and screwed onto the next screen. O-rings on both ends and metal-metal seals of the flow-through coupling will act as a sand control barrier.

In a further embodiment, dissolvable plugs, which may be dissolvable with brine, may be inserted into the base pipe prior to installation, and arranged to dissolve under different brine concentration and temperature. By having the base pipe sealed with special material plugs, while running the screen and well preparation, the use of wash wipes may be avoided. Once ready for production, brine fluid is pumped to dissolve the plugs making the well/screen ready for production.

The ingress passes through the flow-through shroud 75 to arrive at the SSD 80. In this case, the SSD is open having apertures 82 through which the ingress 100 can enter the base pipe to be extracted. Thus, in order to prevent further ingress, the SSD 80 can be closed and so extraction within the respective zone of the well is prevented. Sliding sleeve are welded to the base pipe, which enables it to act as a single component with the Base Pipe. The SSD ID may be bigger than the base pipe ID, and so may avoid any intervention tools to be limited to the SSD ID. With conventional SSD's, there will be a limitation on the SSD ID, to perform the closure of the keys in shifting tool. As discussed, the SSD may be activated by a WL/CT Shifting tool/Tractor tool, which is enabled to select the chosen zone/SSD, as opposed to traditional SSD's which have to be open/close multiple times while reaching desired SSD.

Figure 3A:
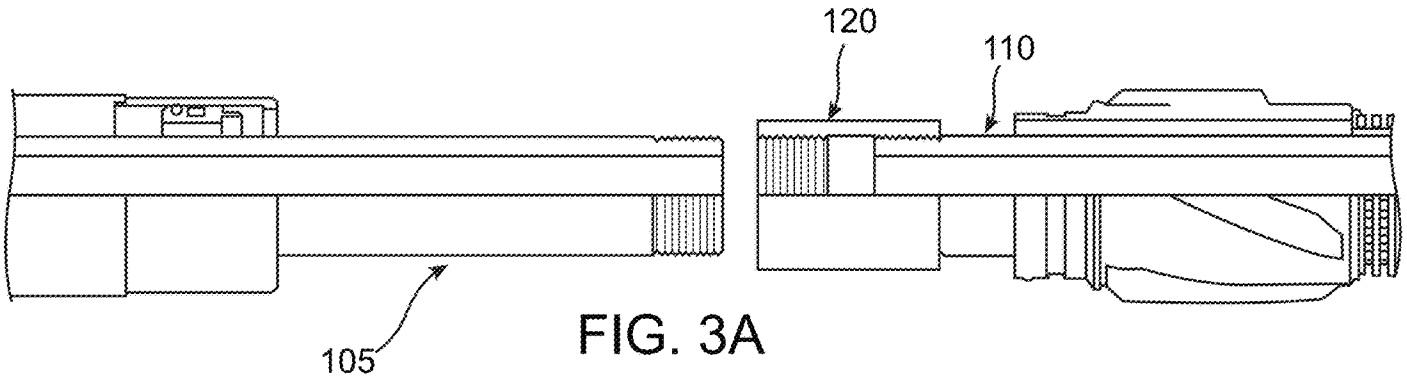
FIGS. 3A and 3B are partial cross-sectional views of a screen assembly according to a further embodiment of the present invention.
Figure 3B:
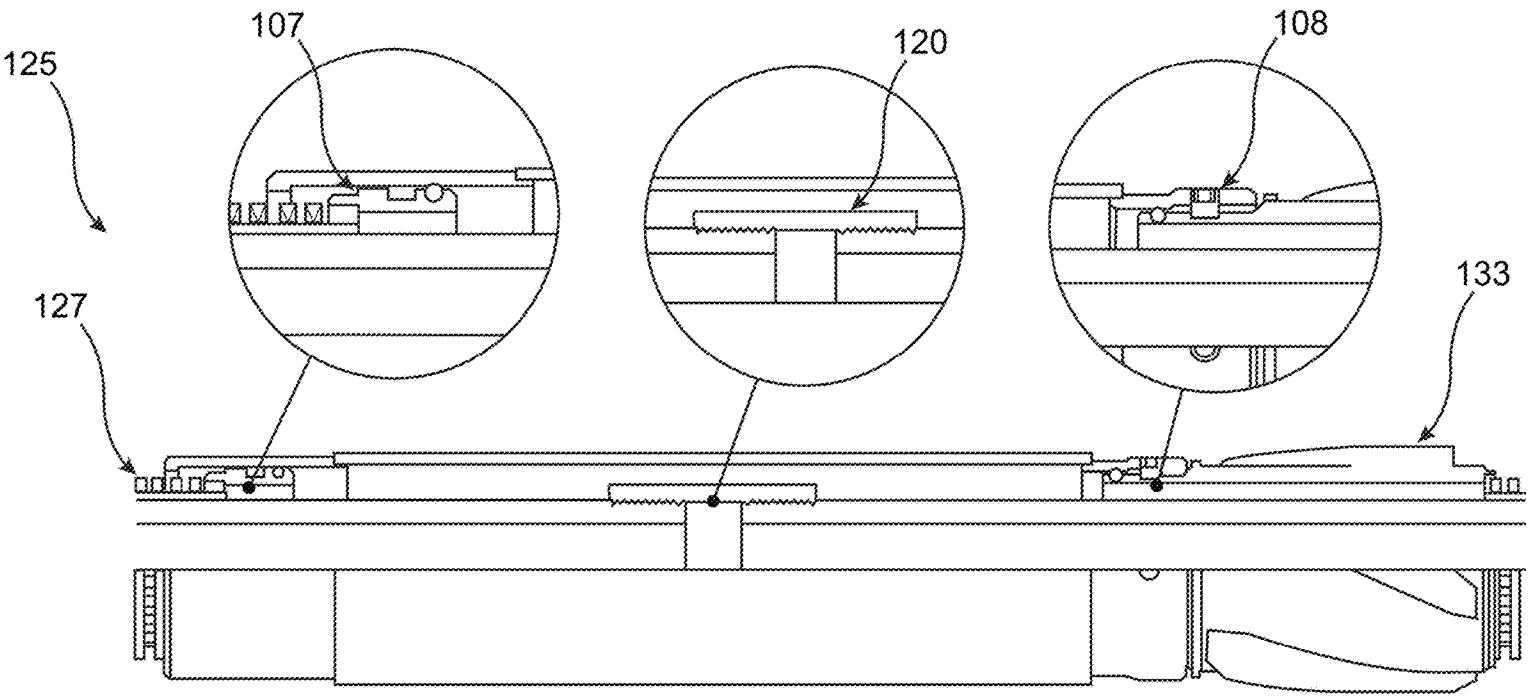

FIGS. 3A and 3B show a before and after of a connection 125 between adjacent strings 105, 110. A flow through connector 120 which is coupled on one string 110 is arranged to connect to the adjacent string 105, and thus allow for the multiple screen assemblies to be attached. Importantly, the flow through connector 120 does not impede flow as it travels along the screen towards the SSD (not shown). FIGS. 3A and 3B also show the flow-through shroud in better detail along which the ingress is able to travel.

The flow enters the direct wrapped screen 127, passing through the flow through end ring 107 and then the shroud, being the last wrap applied to the screen, may be applied to the other layers of the screen. Therefore, in order to allow the ingress to flow along the screen the shroud includes longitudinally directed channels through the shroud to provide a flow path for said ingress.

Figure 4A:
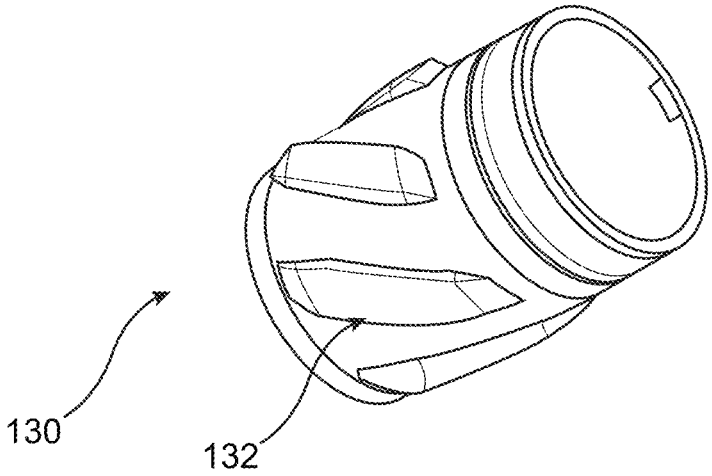
FIGS. 4A and 4B are isometric views of a spiral centralizer according to one embodiment of the present invention.
Figure 4B:
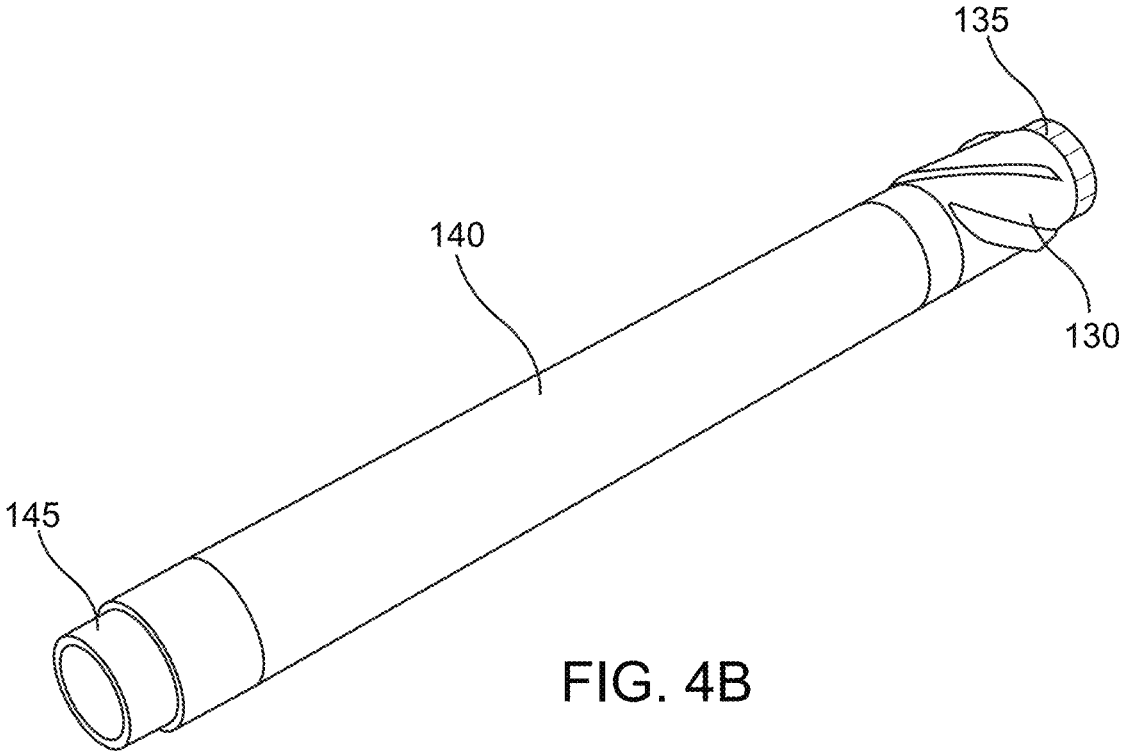

FIGS. 4A and 4B show a spiral centralizer 130 (133 in FIG. 3B) which is attached to the screen 140 by welding. The centralizer 130 includes ridges 132 such that on rotating the screen assembly the ridges 132 contact edges of the well so as to apply a force to the well maintaining a generally concentric position within the well. The centralizer 130 may be connected directly to the shroud and so providing a cover to the various screen layers 135, 145.

Figure 5:
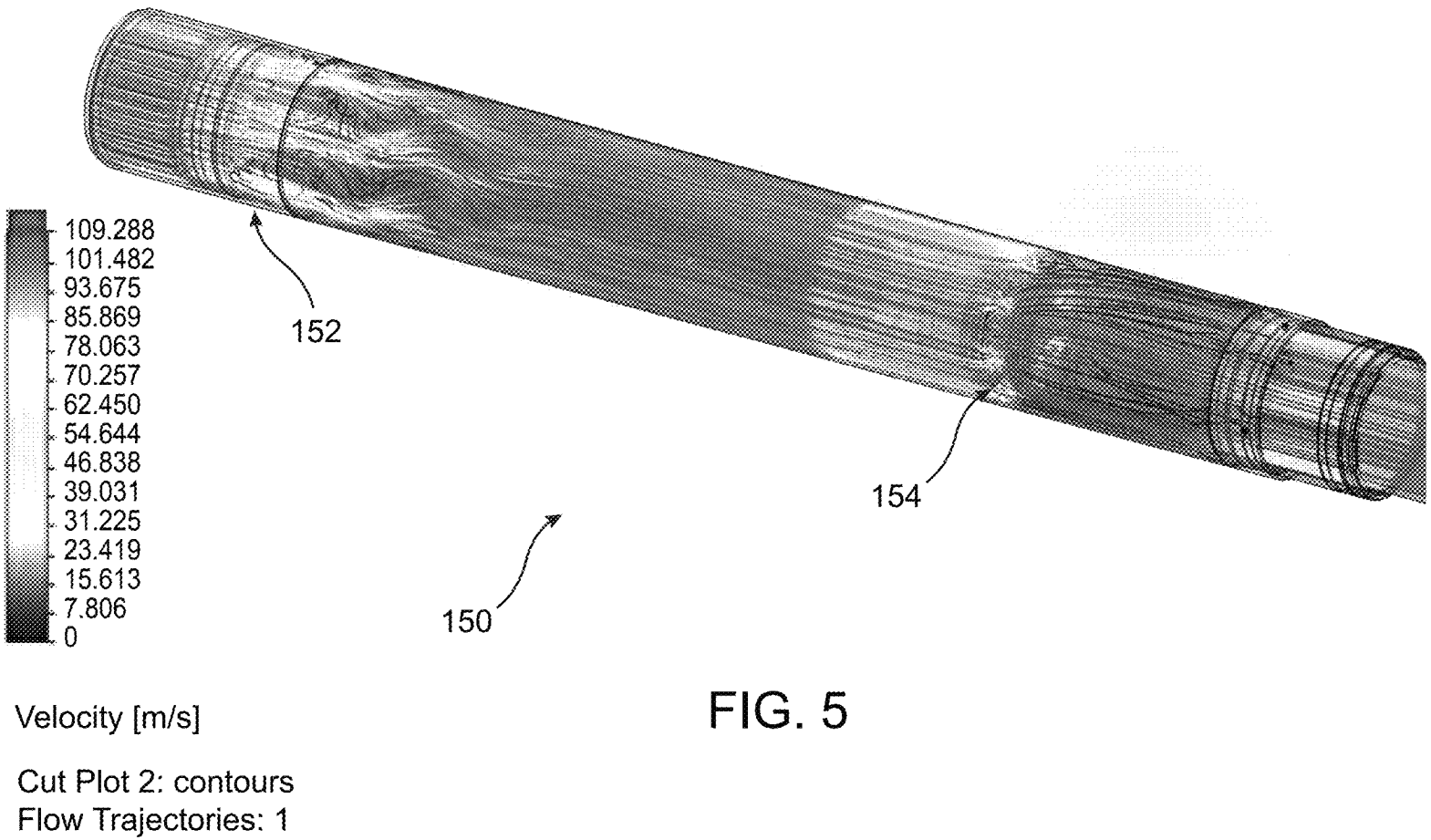
FIG. 5 is a computational fluid dynamics (CFD) image of hydrocarbon flow within a screen according to a further embodiment of the present invention.

FIG. 5 shows the flow path of the ingress as it travels along the screen shows high concentration of turbulent flow 152 as it enters the screen normalizing for the length before entering through the SSD 154.

Figure 6:
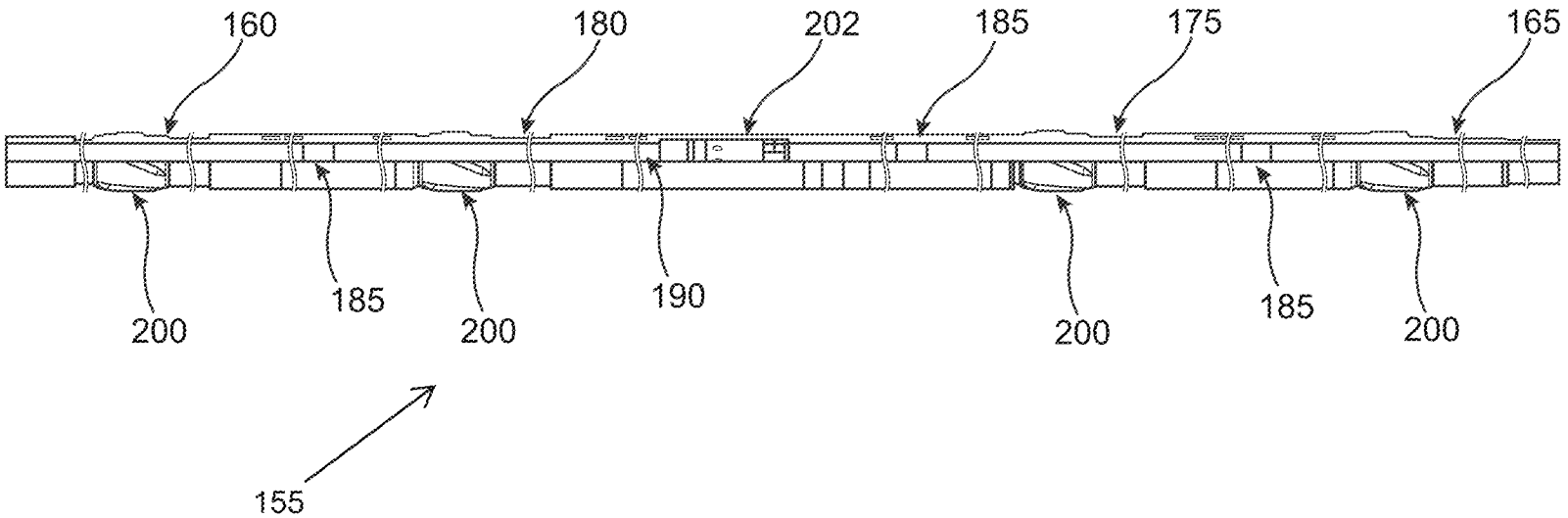
FIG. 6 is a schematic view of an extraction assembly according to a further embodiment of the present invention.

FIG. 6 shows a further embodiment of the extraction system 155 whereby four screen assemblies 160, 165, 175, 180 are connected together through flow-through couplings 185. Centralizers 200 are mounted to each screen assembly so as to provide the centralizing action as the extraction assembly 155 further shows the flow through shroud and also the SSD 202 within one of the screens 180 into which the ingress flows on the basis the SSD 202 has been selected to be opened.

The invention claimed is:

1. An extraction system for extracting hydrocarbons from a well, the system comprising:

an extraction string comprising a plurality of screen assemblies for receiving ingress fluid from the well;

said screen assemblies comprising screens positioned about a base pipe;

a plurality of fluid isolation devices arranged to divide the extraction string into zones, said zones sealed by the fluid isolation devices, such that the zones are in fluid isolation from each other;

each of the zones having at least one of the screen assemblies;

each of the zones having at least one sliding sleeve door (SSD) arranged longitudinally away from said at least one screen assembly; and each of the zones having a flow-through shroud arranged between said at least one screen assembly and said at least one SSD, the flow-through shroud having longitudinally directed channels therethrough that provide a longitudinal flow path for the ingress fluid from said at least one screen assembly towards said at least one SSD, wherein said at least one SSD is configured to be selectively closable, such that said at least one closed SSD prevents the ingress fluid from entering the base pipe, wherein said at least one SSD is configured to be selectively openable, such that said at least one open SSD permits the ingress fluid into said each of the zones, thereby allowing extraction of hydrocarbons in the ingress fluid from said each of the zones, wherein said each of the zones is arranged to be individually and selectively open to receive the ingress fluid or closed to seal said each of the zones from receiving the ingress fluid.

2. The extraction system according to claim 1, wherein the fluid isolation devices include swell packs.

3. The extraction system according to claim 1, wherein each of the zones comprises a plurality of the screen assemblies that are connected using flow-through connectors.

4. The extraction system according to claim 1, further including tracers arranged to identify composition of the ingress and communicate said composition, a decision to open or close any one of the SSDs based upon the communicated composition.

* * * * *